US009039323B2

(12) United States Patent
Seovic

(10) Patent No.: US 9,039,323 B2
(45) Date of Patent: May 26, 2015

(54) GRINDING ATTACHMENT

(71) Applicant: Seovic Civil Engineering Pty Ltd., Narrellan, NSW (AU)

(72) Inventor: Jason John Seovic, Wilton (AU)

(73) Assignee: Seovic Civil Engineering PTY LTD., Narrellan, NSW (AU)

( * ) Notice: Subject to any disclaimer, the term of this patent is extended or adjusted under 35 U.S.C. 154(b) by 68 days.

(21) Appl. No.: 13/836,975

(22) Filed: Mar. 15, 2013

(65) Prior Publication Data

US 2014/0270956 A1 Sep. 18, 2014

(51) Int. Cl.
*E01C 23/16* (2006.01)
*E01C 19/22* (2006.01)
*E01C 23/088* (2006.01)

(52) U.S. Cl.
CPC ..... *E01C 23/088* (2013.01)

(58) Field of Classification Search
CPC ..... E01C 23/088
USPC ..... 404/93, 94, 96; 299/39.4, 39.5, 39.6
See application file for complete search history.

(56) References Cited

U.S. PATENT DOCUMENTS

| | | | | |
|---|---|---|---|---|
| 5,315,770 | A * | 5/1994 | Campbell | 37/96 |
| 5,354,146 | A * | 10/1994 | O'Konek | 299/39.2 |
| 6,612,774 | B1 * | 9/2003 | Dulin | 404/104 |
| 7,748,789 | B2 * | 7/2010 | Freeburn | 299/39.5 |
| 7,789,587 | B2 * | 9/2010 | James | 404/96 |
| 7,837,276 | B2 * | 11/2010 | Kraemer et al. | 299/39.6 |
| 8,016,515 | B2 * | 9/2011 | Benedetti et al. | 404/94 |
| 8,025,342 | B2 * | 9/2011 | Kraemer et al. | 299/39.6 |
| 8,056,549 | B1 * | 11/2011 | Fleetwood | 125/15 |
| 2008/0008527 | A1 * | 1/2008 | Kraemer et al. | 404/94 |
| 2014/0015304 | A1 * | 1/2014 | Rodel et al. | 299/39.4 |

* cited by examiner

*Primary Examiner* — Abigail A Risic
(74) *Attorney, Agent, or Firm* — Reising Ethington P.C.

(57) ABSTRACT

A grinding attachment for highways and similar surfaces is disclosed for grinding operations closer to adjacent obstacles than is possible with existing equipment using a straddle-type centrally mounted grinding drum. The grinding attachment assembly comprises at one end a stub axle, which engages the grinding drum via a head extension. The stub axle is attached to a shroud which is in turn supported by a mounting assembly, which in operation attaches to a vehicle or machine able to drive the grinding attachment. The grinding drum can thereby operate proximal obstacles adjacent a grinding surface by virtue of arrangement of the stub axle, shroud and mounting assembly.

8 Claims, 3 Drawing Sheets

GRINDING ATTACHMENT

FIELD OF THE INVENTION

The present invention relates to grinding and grooving of roadways and related surfaces.

BACKGROUND

Highway grinders are specialty equipment, supplied by few manufacturers. Two key suppliers provide a variety of grooving and grinding equipment for use on roadways and in similar civil engineering contexts. Grinding and grooving equipment is mounted on a purpose-specific vehicle or machine, and the surface treated as the machine progresses.

Existing highway grinders have one distinct disadvantage. They are unable to grind up close to any obstructions adjacent to the machine such as kerbs, poles, barriers etc. Generally, this is not of particular concern, as highway grinding machines are not primarily designed for urban environments, such as local roads. Nominally, however, 650 mm is as close as the existing generation of grinding machines can grind to adjacent obstructions. This is due to the straddle-type grinding head centrally mounted to the machine, which is needed to support a heavy-duty grinding drum.

When immovable obstacles are encountered, such as adjacent walls, kerbs, medians, etc, the existing generation of highway grinders are unable to get sufficiently close the edge of the surface to be grinded or grooved. This necessitates a secondary process, to achieve a consistent result over the grinding surface—that is, a result which is true to grade, and uniform in appearance, with the same longitudinal type line texture. Cold milling machines, also referred to as cold planers are not suited or permitted as a secondary process. Obviously milling equipment can be used as required, but often the texture of the highway grinder is unable to be adequately replicated. At the very least, using two distinct grinders and grinding operations is inefficient.

There accordingly exists a need, in light of the foregoing, for a solution which at least attempts to address these and other problems associated with the existing generation of highway grinding equipment, and their use.

SUMMARY OF THE INVENTION

In a preferred embodiment, the inventive concept arises from, but is not limited to, a recognition that highway grinding can be performed with far less nominal offset from adjacent obstacles by use of a new grinding attachment that can bolt directly to a highway grinding machine as an accessory, and use an existing main shaft thereof for operation of the grinding attachment. In this embodiment, the grinding drum of the grinding attachment has minimal support at one end owing to use of a stub axle arrangement to thereby permit grinding close to obstacles of the aforementioned type.

Accordingly, the present invention—in one aspect—provides a grinding attachment comprising: a longitudinally oriented arbor extension for mounting grinding blades and spacers thereon to form a grinding drum, the arbor extension being adapted for engagement and support at one end to a head shaft supplying a source of torque to the arbor extension; a stub axle to engage and support the arbor extension at an opposite end of the arbor extension; and a mounting assembly to support the stub axle and mount the grinding attachment to a highway grinding vehicle or machine able to drive the head shaft; wherein the grinding drum can thereby operate proximal to obstacles adjacent a grinding surface.

Advantageously, the grinding attachment further comprises a retaining ring mounted on a longitudinal end of the arbor extension proximal the head shaft, and a clamping ring mounted on an opposite longitudinal end of the arbor extension distal the head shaft. These respective rings—the retaining ring and clamping ring—engage the arbor extension by co-operating screw threaded engagement, in which the retaining ring and clamping ring co-operate to retain the blades and spacers on the arbor extension during grinding, and discourage further ingress of grinding slurry between the blades and spacers.

The grinding attachment allows for grinding closer to adjacent obstacles than is possible with existing equipment using a straddle-type centrally mounted grinding drum. As the grinding attachment assembly comprises at one end a stub axle, which engages the grinding drum via a head extension, and the stub axle is attached to a mounting assembly, the grinding drum can thereby operate proximal obstacles adjacent the grinding surface.

DESCRIPTION OF DRAWINGS

The accompanying drawings are referred to in the following description of a preferred embodiment of the invention; wherein.

DESCRIPTION OF PREFERRED EMBODIMENTS

The preferred embodiment of the invention is directed towards a grinding attachment for grinding a surface of a roadway, and able to operate proximal to nearby obstacles.

Figure 1:
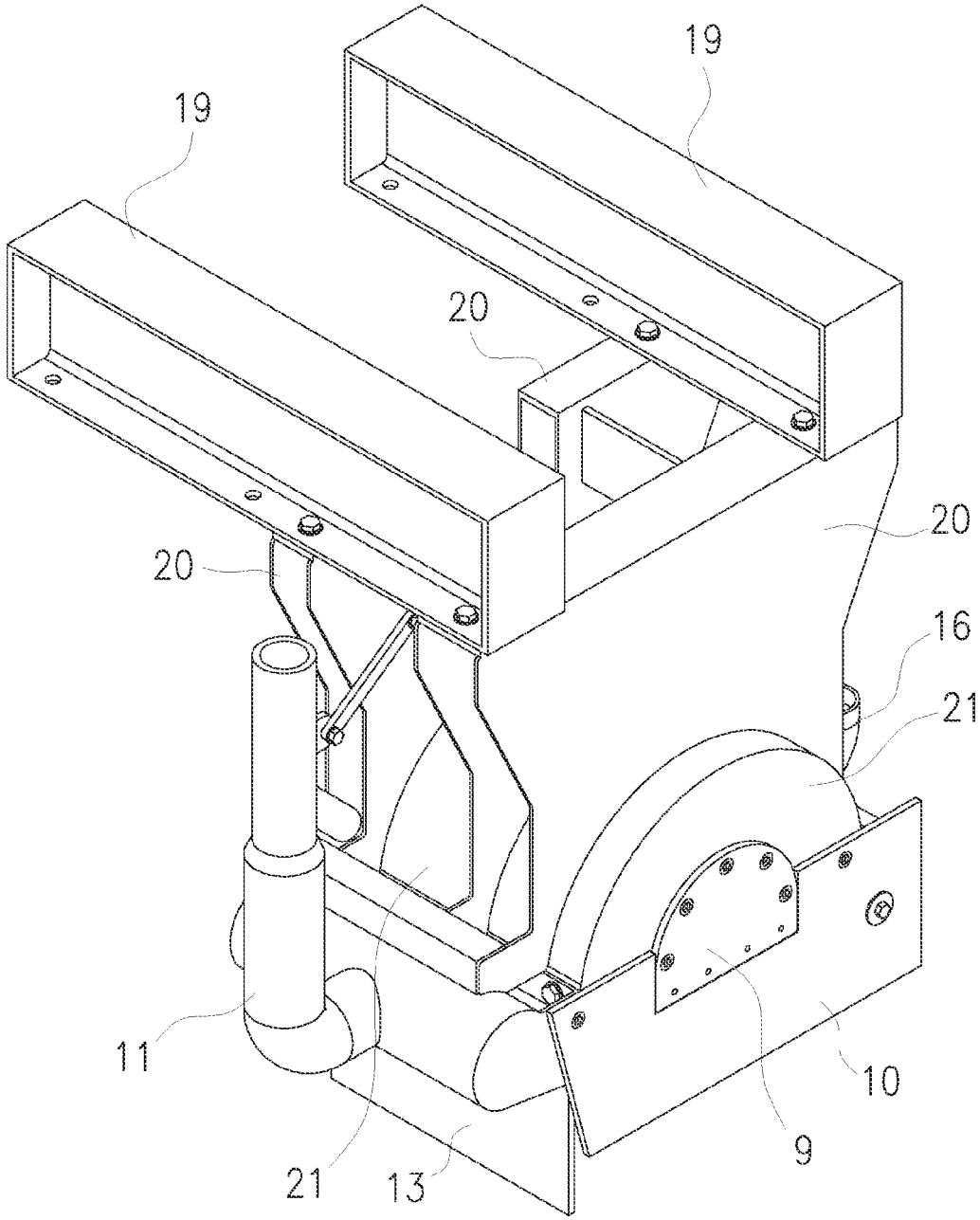
FIG. 1 is a drawing of an isometric view of a preferred embodiment of an assembled grinding attachment, as described herein, from a first perspective.
Figure 2:
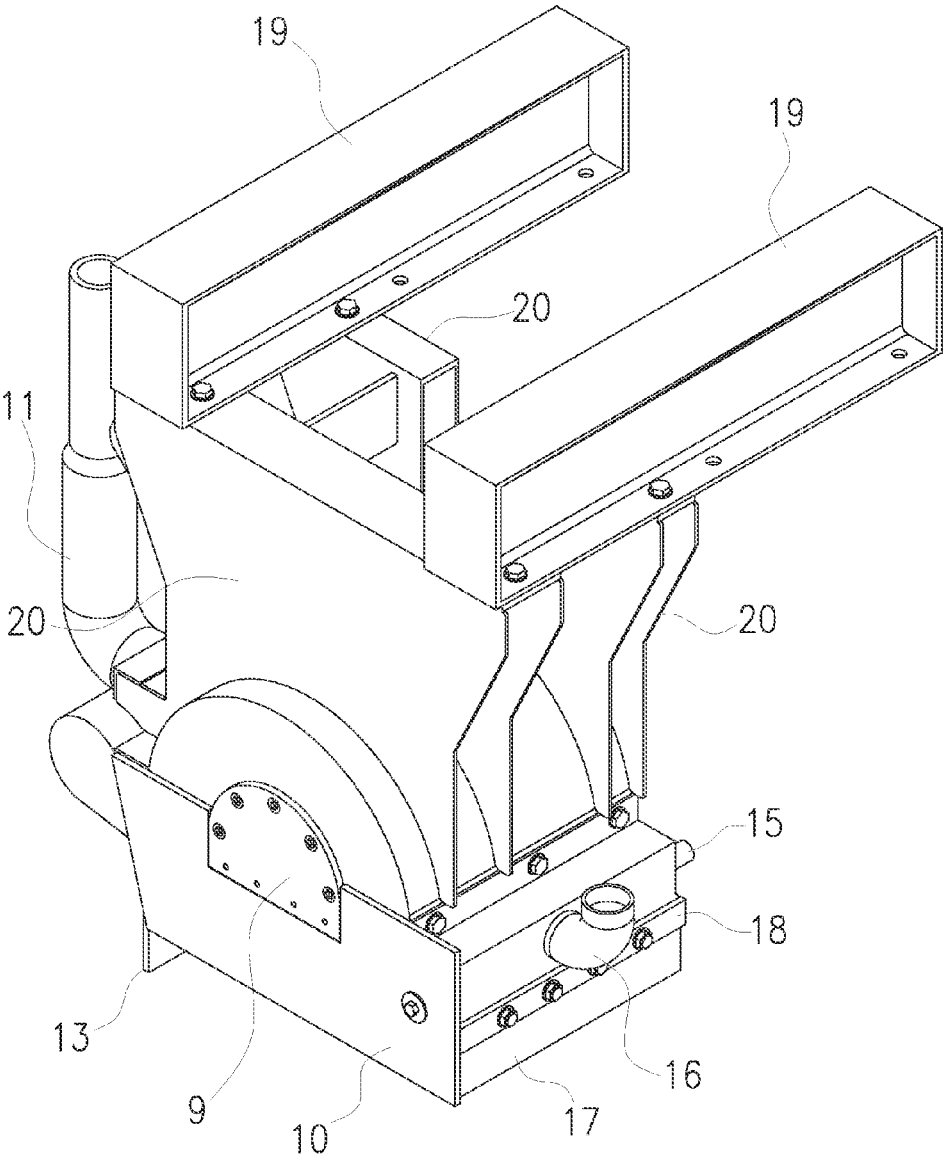
FIG. 2 is a drawing of the preferred embodiment of the assembled grinding attachment of FIG. 1, from a second perspective.

FIGS. 1 and 2 depict in isometric view an assembled grinding attachment for attachment to a highway grinding vehicle or machine of a type generally described above. The components of the grinding attachment, and their assembly, are depicted in the exploded view afforded by FIG. 3.

Referring to the drawings in combination, and particularly FIG. 3, with reference to the list of components detailed below, the grinding attachment is assembled and operated as follows.

The arbor extension 3 is of generally cylindrical configuration with circular cross-section, and arranged in a longitudinal orientation used to mount thereon blades and spacers (not shown) of any desired configuration.

The configuration of blades and spacers is itself immaterial, but is described here for completeness. Typically, the grinding drum is constructed by using a number of diamond cutting blades, which are keyed onto the arbor extension 3 in co-operating keyed engagement. Typically, a pair of diametrically opposed keying structures, or four equi-spaced co-operating keying structures may be most conveniently used. The use of keying structures prevents the blades and spacers from spinning on the arbor extension 3 during grinding, but any suitable method of retaining the blades and spacers may be used as required.

The arbor extension 3 has a nominal outer diameter of 8", which may facilitate use of an existing range of diamond blades from existing suppliers. To achieve a suitable texture imparted by the grinding drum, adjacent diamond cutting blades are spaced apart by spacing wheels, also termed spacers, which serve to space apart the blades. A fine textured grinding drum may be constructed from diamond blades having various widths and various spacing—as an example, blades of a width of approximately 2.5 mm may be used, and spaced apart by interspaced spacing wheels also of approximately 2.5 mm. A range of other configurations can be used according to prevailing requirements.

A longitudinal end of the arbor extension 3 is adapted to engage with an existing main shaft 1, which is not part of the grinding attachment per se, but which is a source of torque which is supplied by the highway grinding (or other) equipment to which the grinding attachment is mounted. During typical full-speed operation, the main shaft 1 may supply power of the order of 600 hp to the grinding drum via the arbor extension 3. The main shaft 1, as depicted has two diametrically opposed keyways for engaging with co-operating keys formed on and internally projecting within the arbor extension 3.

Furthermore, the arbor extension 3 receives two sets of aligned arbor locking screw caps 4 that when fitted are recessed within the outer external surface of the arbor extension (to avoid interfering with fitment of the blades and spacers). The arbor locking screw caps 4 are located within the keyways of the main shaft 1, to locate the main shaft 1 and the arbor extension 3.

The arbor extension 3 has an internal wall (not shown), through which the end locking bolt 5 projects to engage and retain the end of the main shaft 1. The main shaft 1 is thus firmly locked to the arbor extension 3 via use of keyways, cap screws 4, and the end bolt 5.

As can be seen, the main shaft 1—which does not form part of the grinding attachment per se—is depicted in partial view only, as the housing and ancillary equipment to which it is attached is of no further concern. Typically, the main shaft 1 would be driven by an industrial diesel motor mounted on the highway grinder.

The blades and spacers are retained on the arbor extension 3 by use of two internally threaded components which engage with the threaded ends of the arbor extension 3. These components are the threaded retaining ring 2, and the threaded clamping ring 8, which attach to respective longitudinal ends of the arbor extension 3. The threaded retaining ring 2 attaches to the arbor extension at the longitudinal end proximal the main shaft 1, whereas the threaded clamping ring 8 attaches at the opposite longitudinal end of the arbor extension 3 distal the main shaft 1.

With blades and spacers mounted on the arbor extension 3, and the threaded retaining ring 2 and threaded clamping ring 8 retaining the blades and spacers, the grinding drum is attached to and supported by stub axle 9, as depicted.

Mounted within the arbor extension 3 and in co-operation with the stub axle 9 is an internal tapered drum bearing 6, a bearing retaining clip 7A, and a seal and seal retainer 7B, which are assembled as depicted. This sealed bearing arrangement is advantageously adopted for longevity and reliability of operation, since it is found that—as grinding is a wet process—an open bearing is vulnerable to ingress of grinding slurry, which can readily wear an open bearing during operation, thus rendering the grinding attachment vulnerable to untimely failure.

Figure 3:
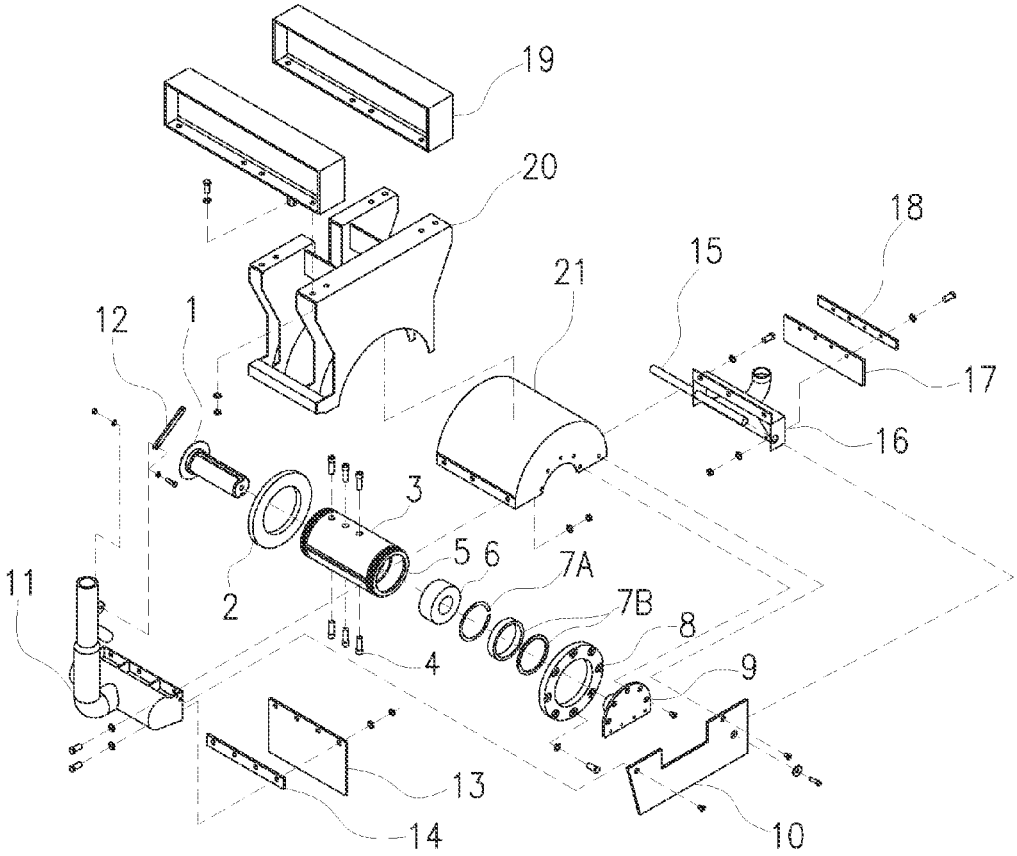
FIG. 3 is a drawing of an exploded isometric view of components of the preferred embodiment of the assembled grinding attachment of FIGS. 1 and 2.

The stub axle 9 is, as depicted by the dashed lines of FIG. 3, supported by the protective shroud 21, which is generally semi-circular in shape, and has a structural end plate circumscribing a semi-circular arc for bolting to the stub axle 9.

The protective shroud 21 thus assists in locating and supporting the stub axle 9, to hold the weight of the grinding head assembly comprising the grinding drum, arbor extension 3, and associated rotating components, and also being sufficiently engineered to absorb forces arising from the downward pressure of the rotating grinding drum, and travel speed of the highway grinding machine.

The arrangement of the floating stub axle 9, and structural end plate of the protective shroud 21 allows for minimal clearance from obstacles adjacent a grinding surface, thereby obviating limitations associated with the existing generation of highway grinding machines, which operate a centrally mounted straddle-type grinding head, which is by design unable to achieve grinding with minimal clearance from adjacent obstacles as already noted.

The protective shroud 21 is structurally welded to a frame 20, and bolted to a pair of mounting beams 19, which in the preferred embodiment described and depicted herein collectively comprise a mounting assembly which is adapted to mount the grinding attachment to a highway grinding machine, as well as support the stub axle 9.

Protective shroud 21 is as described above, and frame 20 comprises as depicted a series of parallel oriented plates, cross-connected by spaced apart cross members which provide rigidity to the frame 20. The mounting beams 19 and essentially simple I-beams. While a quite specific form of frame 20 is depicted, this component can of course take any suitable form able to attach to and support the stub axle 9. Moreover, the mounting assembly itself, comprising the mounting beams 19, frame 20, and protective shroud 20 can take any suitable form adapted to achieve its purpose.

As an example, alternative embodiments may comprise a mounting assembly that does not have a protective shroud 9 of the type described and depicted herein, but a mounting assembly that connects directly to a stub axle 9, with a shroud (if needed) removably attached to the mounting assembly.

A lower edge of the protective shroud 21 at the end plate is adapted for attachment of rubber flap 10 via associated fastening hardware.

Rubber flap 13 is attached with suitable fastening hardware and a steel retaining strip 14 to a primary vacuum head 11, which in turn is fastened to a lower leading edge of the protective shroud 21. The primary vacuum head 11 provides negative pressure or suction for removing grinding slurry created during grinding operations. The primary vacuum head 11 is affixed by vacuum head brace 12.

Similarly, rubber flap 17 is attached with suitable fastening hardware and a steel retaining strip 18 to a secondary vacuum head 16, which in turn is fastened to a lower trailing edge of the protective shroud 21. The secondary vacuum head 16 also provides negative pressure or suction for removing grinding slurry created during grinding operations.

Flexible hoses (not shown) attach to outlets of the vacuum heads 11, 16, and are operatively arranged to lead to a storage tank where the grinding slurry is trapped for later disposal as appropriate.

The rubber flaps 10, 13, 17 collectively comprise a replaceable rubber skirt for the grinding attachment, whose primary purpose is to contain grinding slurry within the grinding attachment, as far as is readily practicable. The rubber flaps 10, 13, 17, and primary vacuum head 11 and secondary vacuum head 16 thus act in concert to remove this slurry for collection and disposal.

Water spray bar 15 is mounted to the secondary vacuum head 16, as depicted to cool the blades, as well discourage air-borne grinding debris from escaping the grinding attachment, and to extinguish grinding spark activity. The water spray bar 15 is of course connected to a water reservoir suitably pressurised and of sufficient capacity to conduct grinding operations of desired duration.

It should be appreciated that the invention has utility with any kind of shaft that has significant load bearing where an extension of the main shaft is necessary to, as in the preferred embodiment, extend the grinding drum axially beyond the normal compass of the grinding drum. In such an arrangement the mounting assembly provides fixed support at the distal end of the extension shaft to stabilize rotation of the extension shaft during application of the torque at the proximal end of the shaft.

Various modifications can made to preferred embodiment of the grinding attachment described herein without departing from the spirit and scope of the present invention.

LIST OF COMPONENTS

1. existing main shaft 1
2. threaded retaining ring 2
3. arbor extension 3
4. arbor locking cap screws 4
5. end locking bolt 5
6. internal tapered drum bearing 6
7. bearing retaining clip 7
8. threaded clamping ring 8
9. stub axle 9
10. rubber flap 10
11. primary vacuum head 11
12. vacuum head brace 12
13. rubber flap 13
14. steel retaining strip 14
15. water spray bar 15
16. secondary vacuum head 16
17. rubber flap 17
18. steel retaining strip 18
19. mounting beams 19
20. edge grinding frame 20
21. protective shroud 21 (with structural end plate for stub axle mounting)

What is claimed is:

1. A grinding attachment mountable on an existing main shaft of a highway grinding vehicle, the grinding attachment comprising:

a longitudinally oriented arbor extension for mounting grinding blades and spacers thereon to form a grinding drum, the arbor extension being adapted at one end for direct mounting on the existing main shaft of the highway grinding vehicle, thereby supplying a source of torque to the grinding attachment;

a floating stub axle having a bearing internal to, and located within, the arbor extension which operatively engages the arbor extension at an opposite end of the arbor extension; and a mounting assembly to support the floating stub axle and mount the grinding attachment to the highway grinding vehicle;

wherein the grinding drum can thereby operate proximal to obstacles adjacent a grinding surface, and wherein the grinding attachment is mountable to the existing main shaft of the highway grinding vehicle.

2. A grinding attachment according to claim 1, further comprising a retaining ring mounted on a longitudinal end of the arbor extension proximal the existing main shaft, and a clamping ring mounted on an opposite longitudinal end of the arbor extension distal the existing main shaft, said respective rings engaging the arbor extension by co-operating screw threaded engagement, wherein the retaining ring and clamping ring co-operate to retain blades and spacers on the arbor extension during operation.

3. A grinding attachment according to claim 1, wherein the mounting assembly comprises two or more mounting beams, a frame, and a protective shroud, wherein the protective shroud has a structural end plate removable attachable to the floating stub axle.

4. A grinding attachment according to claim 1, wherein the arbor extension has at least partly along its longitudinal length a key structure for mounting grinding blades and spacers.

5. A grinding attachment according to claim 1, further comprising a removably attachable rubber skirt comprising a number of rubber flaps.

6. A grinding attachment according to claim 3, further comprising primary and secondary vacuum heads attached to the protective shroud.

7. A grinding attachment according to claim 1, wherein the bearing of the floating stub axle is an internal tapered drum bearing mounted within the arbor extension in co-operation with the floating stub axle.

8. A grinding attachment according to claim 7, wherein the internal tapered drum bearing is retained by a bearing retaining clip and a seal retainer.

* * * * *